United States Patent [19]

Rundell

[11] Patent Number: 4,784,705

[45] Date of Patent: Nov. 15, 1988

[54] WROUGHT HIGH SILICON HEAT RESISTANT ALLOYS

[75] Inventor: Gene Rundell, Adrian, Mich.

[73] Assignee: Rolled Alloys, Inc., Temperance, Mich.

[21] Appl. No.: 35,356

[22] Filed: Apr. 6, 1987

[51] Int. Cl.[4] ..... C22C 38/34

[52] U.S. Cl. ..... 148/327; 420/50

[58] Field of Search ..... 148/327; 420/50, 55

[56] References Cited

U.S. PATENT DOCUMENTS

| | | | |
|---|---|---|---|
| 2,534,190 | 12/1950 | Zikmund | 420/112 |
| 2,580,171 | 12/1951 | Hagglund et al. | 420/62 |
| 2,934,430 | 4/1960 | Klaybor et al. | 420/67 |
| 3,138,457 | 6/1964 | Edwards | 420/428 |
| 4,058,416 | 11/1977 | Eiselstein et al. | 420/584 |
| 4,063,935 | 12/1977 | Fujioka et al. | 420/50 |
| 4,077,801 | 3/1978 | Heyer | 420/584 |
| 4,385,933 | 5/1983 | Ehrlich et al. | 430/53 |
| 4,388,125 | 6/1983 | Benn | 420/452 |

FOREIGN PATENT DOCUMENTS

| | | | |
|---|---|---|---|
| 50-109116 | 8/1975 | Japan | 148/327 |
| 57-79153 | 5/1982 | Japan | 420/50 |

OTHER PUBLICATIONS

"Evaluation of Heat Resistant Alloys in Composite Fixtures", G. R. Rundell, NACE, Paper Number 377.

*Primary Examiner*—Deborah Yee

*Attorney, Agent, or Firm*—Webb, Burden, Ziesenheim & Webb

[57] ABSTRACT

A new wrought high silicon heat resistant alloy is provided having the broad composition of about 0.16 to 0.30% carbon, about 3.2 to 4.5% silicon, about 0.8 to 1.5% aluminum, about 17 to 20% chromium, about 12 to 16% nickel, up to about 2% manganese, 0 to 0.07% rare earth alloys and the balance iron with residual impurities in ordinary amounts. The alloy is a fully austenitic hot rolled and annealed chromium and nickel containing alloy having high strength and corrosion resistance.

10 Claims, No Drawings

WROUGHT HIGH SILICON HEAT RESISTANT ALLOYS

The present invention relates to wrought high silicon heat resistant alloys and particularly to a fully austenitic hot rolled and annealed chromium and nickel containing alloy having a relatively high silicon and aluminum content with more carbon than can be dissolved in the alloy at the annealing temperature so that carbide becomes a second phase in the alloy.

The problem of providing heat and corrosion resistance in alloys has been addressed by many metallurgists over the years with a variety of alloys being proposed for the solution of problems presented to their developer. Many of these alloys are chromium nickel containing alloys. Among such alloys are those described in Heyer et al. U.S. Pat. No. 4,077,801, Edwards U.S. Pat. No. 3,138,457, Benn U.S. Pat. No. 4,388,125, Eiselstein et al. U.S. Pat. No. 4,058,416, Ehrlich et al. U.S. Pat. No. 4,385,933. Klaybor et al. U.S. Pat. No. 2,934,430, Hagglund et al. U.S. Pat. No. 2,580,171, Zikmund et al. U.S. Pat. No. 2,534,190 and Fujioka et al. U.S. Pat. No. 4,063,935.

The present alloy is designed to provide not only resistance to heat and oxidization but also to provide high temperature strengthening, controlled annealed fine grain size and austenitic stability. This provides a relativley low cost alloy in the austenitic state substantially free of ferrite in the hot rolled annealed condition. This is accomplished by alloy additions which go contrary to the prevaling beliefs of the metallurgical industry. For example, the beneficial effects of silicon on resistance to carburization have been recognized for many years. However, it is unusual to add more than 2½% of silicon to an iron-chromium-nickel grade because such additions result in severe embrittlement when these alloys are used below temperatures of 1700° F. I have discovered that by controlling the carbon and chromium content in the present invention this problem of embrittlement can be controlled. In the industry it is believed that silicon alone or silicon plus aluminum will severely limit weldability. In my alloy composition I have found that this is not a problem. My alloy contains an amount of carbon considerably above that normally used in corresponding oxidation resistant alloy. I have discovered, however, that the carbon as called for in my composition povides high temperature strengthening, contributes to austenitic stability, retards undesirable grain coarsening and is essential in preventing embrittlement. The amount of carbon added in the present composition is such that it exceeds the amount that can be dissolved at the annealing temperature and as a result carbide actually appears as a second phase in the alloy. The carbon content of the alloy is critical and permits the inclusion of higher levels of aluminum and silicon to provide a fully austenitic alloy as hot rolled and annealed.

The present invention provides a wrought high silicon heat resistant alloy of the austenitic type comprising about 0.16 to 0.30% carbon, about 3.2 to 4.5% silicon, about 0.8 to 1.5% aluminum, about 17 to 20% chromium, about 12 to 16% nickel, up to about 2% manganese, and the balance iron with usual impurities in ordinary amounts. The invention also contemplates the addition of up to about 0.07% of a rare earth metal or metals such as cerium to improve oxidation resistance where necessary. Preferably the alloy of this invention comprises abuout 0.20% carbon, about 3.5% silicon, about 1% aluminum, about 18.5% chromium, about 14.5% nickel, about 0.6% manganese and the balance iron with residual impurities in ordinary amounts. The alloy is preferably hot rolled and annealed at about 2000° to 2200° F.

The alloy of this invention was compared with available commercial materials for various properties, including resistance to pack carburization, resistance to corrosion in sulfurizing atmospheres, isothermal oxidation resistance in still air, cyclic oxidation resistance in still air and stress to produce one percent creep in 10,000 hours at 1800° F.

The composition of the alloy of this invention used in these tests was:

C—0.20%
Si—3.64%
Al—1.04%
Cr—18.36%
Ni—14.36%
Mn—0.57%
Fe—Balance with Residuals of:
N—0.01%
P—0.019%
S—0.001%
Mo—0.25%
Cu—0.34%
Co—0.05%

The test results appear in the following tables:

TABLE I

LABORATORY PACK CARBURIZING TEST IN PULVERIZED COAL (1950° F. - 30 Days)

| Alloy Designation | % Tensile Ductility After Carburization |
|---|---|
| 601 | 15% |
| Alloy of invention | 11% |
| Cabot 214 | 4.0% |
| RA333 | 1.5% |
| RA 253 MA | 0.5% |
| T302 B | Nil |

These tests show that the alloy of this invention has superior carburization resistance. The criteria used for evaluation in tensile ductility after exposure to carburizing conditions. The alloy of this invention is superior to every alloy except alloy 601 which is an expensive nickel-base alloy.

The compositions of the prior art alloys used in this test are:

| | C | Si | Mn | Ni | Cr | N | Al | Ti | Fe |
|---|---|---|---|---|---|---|---|---|---|
| 601 | .049 | .22 | .18 | 61.9 | 22.4 | — | 1.31 | .42 | 13.5 |
| Cabot 214 (nominal) | .04 | — | — | Bal | 16 | — | 4.5 | — | 2.5 Y Present |
| RA 333 | .032 | 1.20 | 1.32 | 47.1 | 25.1 | — | — | — | Bal W-2.7 Mo-2.8 Co-2.9 |

-continued

| | C | Si | Mn | Ni | Cr | N | Al | Ti | | Fe |
|---|---|---|---|---|---|---|---|---|---|---|
| RA253MA | .088 | 1.73 | .70 | 10.9 | 21.2 | .17 | — | — | Bal | Ce-.03 |
| T302B | .076 | 2.25 | 1.77 | 9.8 | 17.4 | — | — | — | Bal | |

TABLE II

RESISTANCE TO CORROSION IN SULFURIZING ATMOSPHERE
(Corrosion Rate at 1000° F. in 4½ months)

| Alloy | Corrosion, mils |
|---|---|
| RA 446 | 1.3 |
| Alloy of invention | 1.6 |
| 309 | 2.0 |
| RA 253 | 3.8 |
| 601 | 5.5 |
| 310 | 5.9 |
| 330 | 6.9 |
| 333 | 8.8 |

Here the ferritic high chromium alloy 446 contaiining no nickel is the only alloy superior to the alloy of the invention. Of the austenitic alloys, the alloy of the present invention is far superior in corrosion in sulfurizing atmosphere.

The compositions of the prior art alloys used in this test are:

| | C | Si | Mn | Ni | Cr | N | Ti | Al | Fe | Other |
|---|---|---|---|---|---|---|---|---|---|---|
| RA446 | .06 | .37 | .72 | .29 | 26.2 | .09 | — | — | Bal | |
| 309 | .06 | .28 | 1.59 | 13.06 | 22.50 | — | — | — | Bal | |
| RA253 | .083 | 1.74 | .50 | 11.0 | 20.9 | .17 | — | — | Bal | Ce .05 |
| 601 | | | | | Not Available | | | | | |
| 310 | .048 | .52 | 1.29 | 20.07 | 24.33 | .03 | — | — | Bal | |
| 330 | .057 | 1.12 | 1.61 | 34.81 | 19.20 | .01 | — | — | Bal | |
| 333 | .054 | 1.45 | 1.26 | 45.80 | 25.00 | — | — | — | Bal | W 2.80<br>Mo 2.70<br>Co 2.95 |

TABLE III

OXIDATION RESISTANCE
(Isothermal Exposure in Still Air)

| Alloy | Metal Loss After 3,000 hrs. in mils | |
|---|---|---|
| | 2100° F. | 2200° F. |
| Alloy of Invention | 2.79 | 4.77 |
| RA 310 | 2.15 | 3.47 |
| RA 253 | 3.14 | 82.00 |
| RA 330 | 2.77 | 4.42 |

The alloy of the invention is similar in resistance to more costly materials such as RA 330 and far superior to RA 253 which has similar levels of chromium and nickel and is thus similar in cost.

TABLE IV

OXIDATION RESISTANCE
(Cyclic Exposure at 2100° F. in Still Air)

| Alloys | Metal Loss After 500 hrs in mils |
|---|---|
| Alloy of Invention | 11.5 |
| RA 330 | 9.1 |
| RA 253 | 10.5 |
| RA 310 | 7.1 |
| 800 | 18.0 |

The alloy is similar to the more costly RA 330 and much superior to the high nickel-chromium alloy 800.

The compositions of the prior art alloys used in the two tests are:

| | C | Si | Mn | Ni | Cr | N | Ti | Al | Fe | Other |
|---|---|---|---|---|---|---|---|---|---|---|
| RA310 | .069 | .75 | 1.53 | 19.41 | 24.45 | — | — | — | Bal | — |
| RA253 | .086 | 1.45 | .73 | 10.8 | 20.7 | .184 | — | — | Bal | Ce .05 |
| RA330 | .061 | 1.30 | 1.46 | 34.99 | 18.15 | — | — | — | Bal | W .18 |
| 800 | .08 | .30 | .94 | 30.76 | 20.78 | — | .44 | .42 | 45.76 | Cu .52 |

TABLE V

LABORATORY PACK CARBURIZING IN ACTIVATED COKE
(1800° F. - 360 h)

| Alloy | Amount of Carbon Absorbed At Indicated Depth From Surface in % | | | | | |
|---|---|---|---|---|---|---|
| | 0.00 to 0.02 in | 0.02 to 0.04 in | 0.04 to 0.06 in | 0.06 to 0.08 in | 0.08 to 0.10 in | 0.10 to 0.12 in |
| Alloy of invention | 0.44 | 0.38 | 0.29 | 0.27 | 0.14 | 0.07 |
| RA 330 | 1.03 | 0.77 | 0.75 | 0.43 | 0.21 | 0.14 |
| RA 253 MA | 1.08 | 1.01 | 0.80 | 0.73 | 0.53 | 0.38 |

The composition of the prior art alloys used in this test are:

| | C | Si | Mn | Ni | Cr | N | Fe |
|---|---|---|---|---|---|---|---|
| RA253 | .086 | 1.45 | .73 | 10.8 | 20.7 | .184 | Bal |
| RA 330 | .061 | 1.30 | 1.46 | 34.99 | 18.15 | — | Bal |

Here the alloy ofthe invention is far superior tomuch more highly alloyed and costly materials in resistance to carburization.

TABLE VI

STRESS TO PRODUCE ONE PERCENT CREEP
(In 10,000 hrs at 1800° F.)

| Alloy | Stress, psi |
|---|---|
| Alloy of Invention | 1400 |
| RA 253 | 460 |

TABLE VI-continued

| STRESS TO PRODUCE ONE PERCENT CREEP (In 10,000 hrs at 1800° F.) | |
|---|---|
| Alloy | Stress, psi |
| RA 330 | 170 |
| 310 | 280 |
| 333 | 800 |
| 601 | 750 |

The alloy of this invention is the strongest alloy by a large factor. This strength is the result of the carbon content and a solution anneal at 2150° F.

This high strength is a unique characteristic of the steel of this invention when coupled with corrosion resistance, oxidation resistance and resistance to carburization.

Creep testing results are generally not based on one heat of an alloy but at least three. The data for 601 is taken from Inco literature with *no* heat identification. The data for RA253 was obtained from many heats. Data for RA330 is from 12 heats. Creep strength for these materials is not highly dependent on minor variations in composition. Nominal composition for the prior art alloys used in this test are:

| | C | Si | Mn | Ni | Cr | N | Fe |
|---|---|---|---|---|---|---|---|
| RA253 | .10 | 1.7 | .5 | 11 | 21 | .17 | Bal |
| RA330 | .05 | 1.3 | 1.0 | 35 | 19 | — | Bal |
| RA310 | .05 | 0.5 | 1.0 | 20 | 25 | — | Bal |
| RA333 | .05 | 1.3 | 1.0 | 45 | 25 | — | Bal |
| 601 | .03 | .2 | .2 | 61 | 23 | — | Bal |

In the foregoing specification certain preferred embodiments and practices of this invention have been set out, however, it will be understood that this invention may be otherwise embodied within the scope of the following claims.

I claim:

1. A fully austenitic wrought high silicon heat resistant weldable alloy in an annealed condition comprising about 0.16 to 0.30% carbon, about 3,2 to 4.5% silicon, about 0.8 to 1.5% aluminum, about 17 to 20% chromium, about 12 to 16% nickel, up to about 2% manganese, 0 to about 0.07% rare earth metals and the balance iron with residual impurities in ordinary amounts whereby after annealing a second phase of carbide is formed to prevent embrittlement.

2. The alloy as claimed in claim 1 which has been hot rolled and annealed at about 2000° F to 2200° F.

3. The alloy as claimed in claims 1 or 2 comprising about 0.16 to 0.30% carbon, about 3.2 to 4.5% silicon, about 0.8 to 1.5% aluminum, about 17 to 20% chromium, about 12 to 16% nickel, up to about 2% manganese and the balance iron with usual impurities in ordinary amounts.

4. The alloy as claimed in claim 1 or 2 comprising about 0.2% carbon, about 3.5% silicon, about 1% aluminum, about 18.5% chromium, about 14.5% nickel, about 0.6% manganese and the balance iron with residual impurities in ordinary amounts.

5. The alloy as claimed in claim 3 having about 0.02% to 0.07% rare earth metals.

6. The alloy as claimed in claim 5 wherein the rare earth metal is cerium.

7. The alloy as claimed in claim 4 having about 0.05% rare earth metals.

8. The alloy as claimed in claim 5 wherein the rare earth metal is cerium.

9. A fully austenitic high strength weldable corrosion resistant article which has been hot rolled and annealed comprising about 0.16 to 0.30% carbon, about 3.2 to 4.5% silicon, about 0.8 to 1.5% aluminum, about 17 to 20% chromium, about 12 to 16% nickel, up to about 2% manganese, 0 to about 0.7% rare earth metals and the balance iron with residual impurities in ordinary amounts whereby after annealing a second phase of carbide is present to prevent embrittlement.

10. A high strength corrosion resistant article as claimed in claim 9 which has been annealed at 2000° F. to 2200° F.

* * * * *

UNITED STATES PATENT AND TRADEMARK OFFICE

CERTIFICATE OF CORRECTION

PATENT NO. : 4,784,705

DATED : November 15, 1988

INVENTOR(S) : Gene Rundell

It is certified that error appears in the above-identified patent and that said Letters Patent is hereby corrected as shown below:

Column 2 Line 54 "in" should read --is--.

Column 3 Line 21 "contaiining" should read --containing--.

Column 4 Line 60 "ofthe" should read --of the--.

Column 4 Line 60 "tomuch" should read --to much--.

Claim 1 Column 5 Line 42 "3,2" should read --3.2--.

Signed and Sealed this

Fourth Day of July, 1989

*Attest:*

DONALD J. QUIGG

*Attesting Officer*

*Commissioner of Patents and Trademarks*